US005758984A

United States Patent [19]

Doherty

[11] Patent Number: 5,758,984

[45] Date of Patent: Jun. 2, 1998

[54] CONDITIONING AND UNTANGLING HAIRBRUSH

[76] Inventor: Angela Doherty, 2750 Johnson Ave., Apt. 9D, Bronx, N.Y. 10463

[21] Appl. No.: 672,271

[22] Filed: Jun. 26, 1996

[51] Int. Cl.[6] ..... A46B 11/02; A45D 24/26

[52] U.S. Cl. ..... 401/184; 401/186; 401/287

[58] Field of Search ..... 401/156, 183–6, 401/276, 277, 278, 279, 286, 287

[56] References Cited

U.S. PATENT DOCUMENTS

| | | | |
|---|---|---|---|
| 912,719 | 2/1909 | McMurran | 401/184 |
| 2,226,663 | 12/1940 | Hill et al. | 401/184 |
| 2,569,276 | 9/1951 | Baptist | 401/184 |
| 2,594,721 | 4/1952 | Beebe | 401/186 X |
| 2,943,602 | 7/1960 | Rundle | 401/186 X |
| 5,338,124 | 8/1994 | Spicer et al. | 401/184 X |

FOREIGN PATENT DOCUMENTS

| | | | |
|---|---|---|---|
| 2257115 | 5/1973 | Germany | 401/185 |

*Primary Examiner*—Danton D. DeMille

*Attorney, Agent, or Firm*—Michael I. Kroll

[57] ABSTRACT

A conditioning and untangling hairbrush (10) comprising a handle (12) having a compartment (14) and an interconnecting passageway (16), whereby the compartment (14) holds a hair conditioner fluid (18) therein. An enlarged head (20) is provided having a chamber (22). The enlarged head (20) is integral with the handle (12), so that the chamber (22) fluidly connected to the passageway (16) in the handle (12). A plurality of bristles (24) extend upwardly from a top surface (26) of the enlarged head (20). A facility (28) is for dispensing the hair conditioner fluid (18) from the compartment (14) through the passageway (16), through the chamber (22) and into the bristles (24). The hair conditioner fluid (18) can be massaged by the bristles (24) directly into and smoothly through long hair on the head of a person to eliminate knots and tangles in the hair.

1 Claim, 2 Drawing Sheets

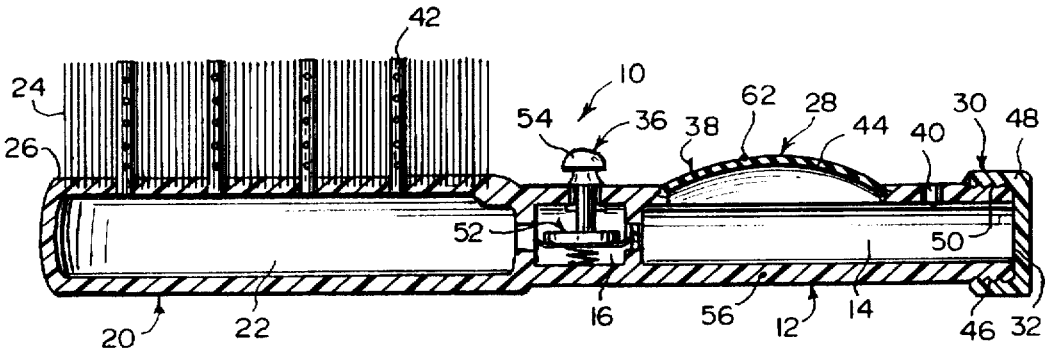
Fig. 3
Fig. 4
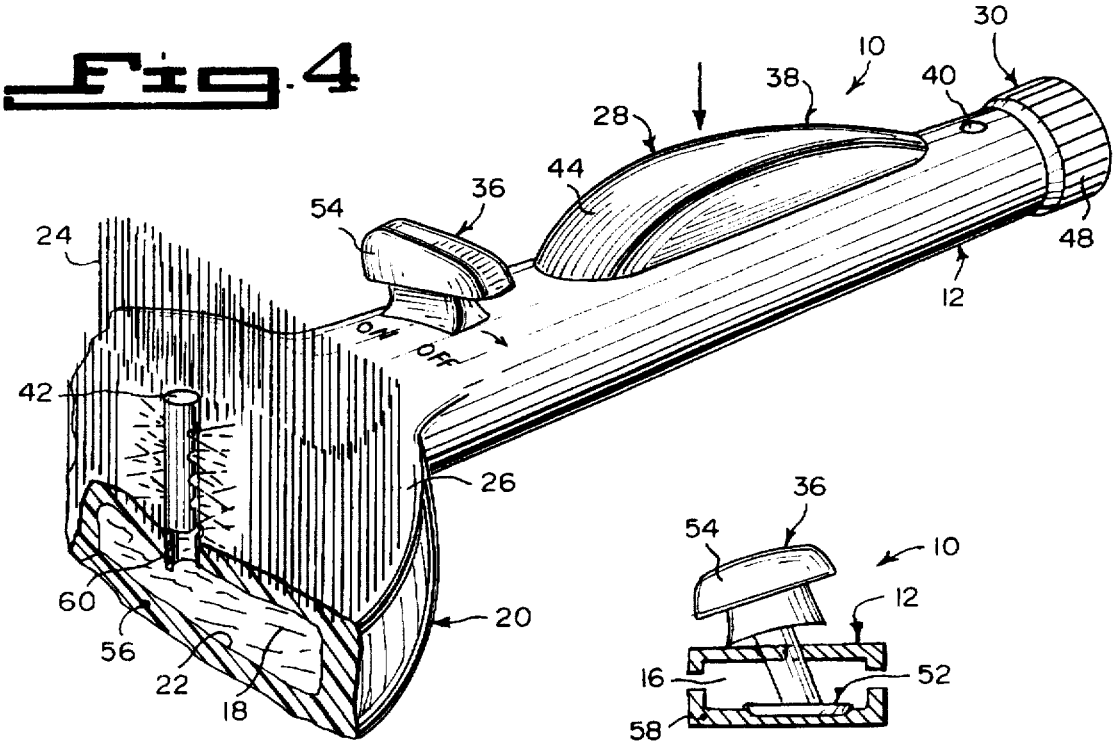
Fig. 7
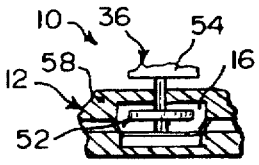
Fig. 5
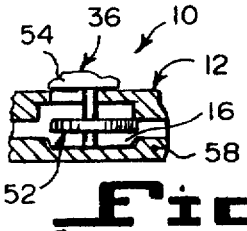
Fig. 6

CONDITIONING AND UNTANGLING HAIRBRUSH

BACKGROUND OF THE INVENTION

1. Field of the Invention

The instant invention relates generally to hairbrushes and more specifically it relates to a conditioning and untangling hairbrush.

2. Description of the Prior Art

Numerous hairbrushes have been provided in prior art that are devices consisting of bristles fastened into handles, adapted to be utilized to clean and groom the hair on the heads of people. While these units may be suitable for the particular purpose to which they address, they would not be as suitable for the purposes of the present invention as heretofore described.

SUMMARY OF THE INVENTION

A primary object of the present invention is to provide a conditioning and untangling hairbrush that will overcome the shortcomings of the prior art devices.

Another object is to provide a conditioning and untangling hairbrush that is primarily used for massaging hair conditioner fluid in the bristles directly into long hair on the head of a person, to eliminate knots and tangles in the hair.

An additional object is to provide a conditioning and untangling hairbrush that contains a compartment in the handle to store the hair conditioner fluid and a built-in mechanism to pump the hair conditioner fluid into the bristles, so that the bristles slick with the hair conditioner fluid can move smoothly through the long hair.

A further object is to provide a conditioning and untangling hairbrush that is simple and easy to use.

A still further object is to provide a conditioning and untangling hairbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a cross sectional view taken along line 3—3 in FIG. 1.

FIG. 4 is an enlarged perspective view similar to FIG. 1, with the head broken away and in section.

FIG. 5 is a partial diagrammatic cross sectional view of the switch assembly in the off position.

FIG. 6 is a partial diagrammatic cross sectional view similar to FIG. 5, with the switch assembly in the on position.

FIG. 7 is an additional partial diagrammatic cross sectional view of the switch assembly in the on position.

Similar reference characters denote corresponding features consistently throughout the attached drawings.

DETAILED DESCRIPTION OF THE PREFERRED EMBODIMENTS

Figure 1:
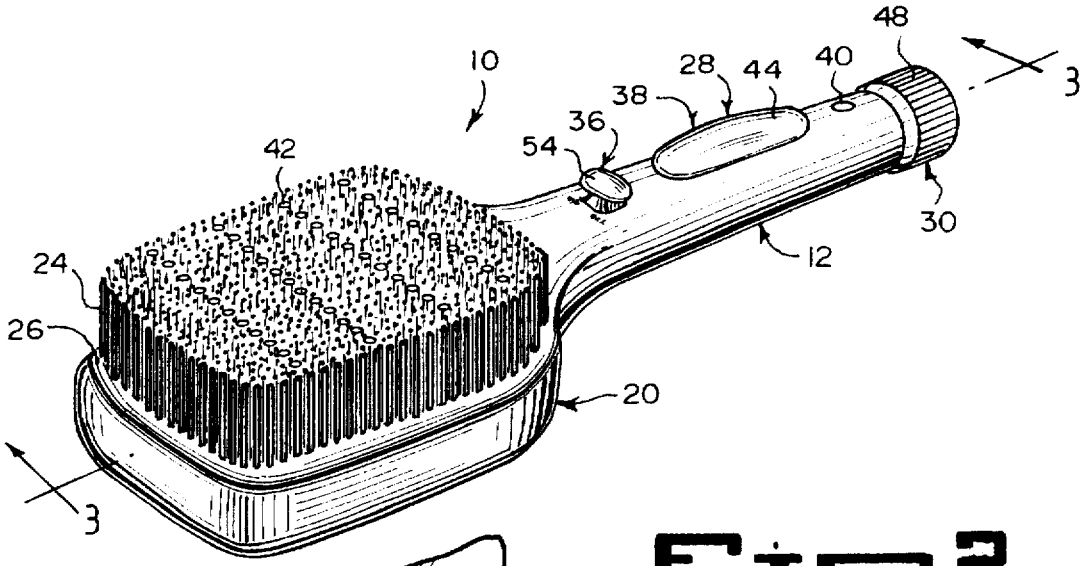
FIG. 1 is a perspective view of the instant invention.
Figure 2:
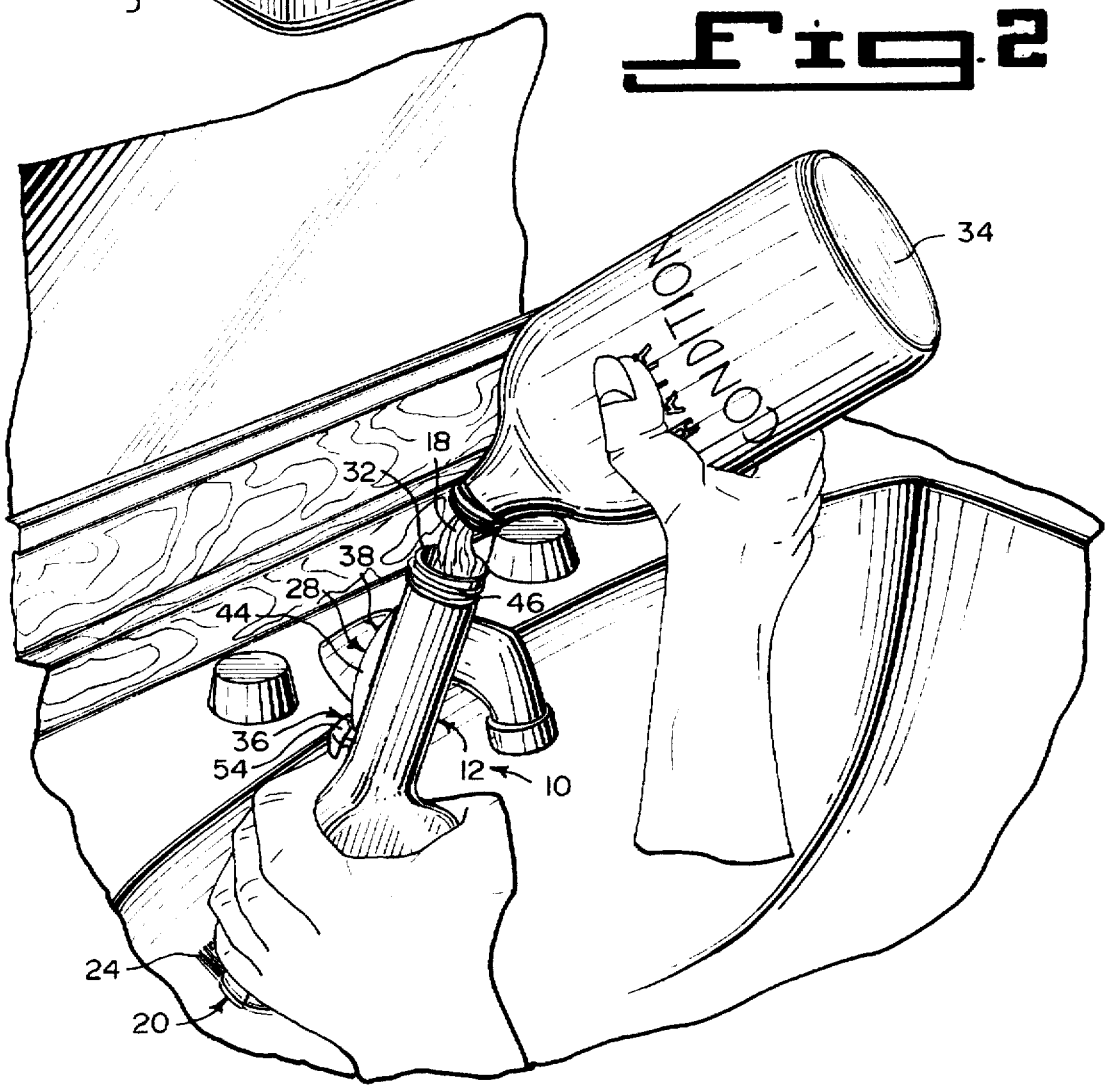
FIG. 2 is a perspective view showing a person inserting a liquid hair conditioner into the compartment in the handle of the instant invention.

Turning now descriptively to the drawings, in which similar reference characters denote similar elements throughout the several views, FIGS. 1 through 7 illustrate a conditioning and untangling hairbrush 10 comprising a handle 12 having a compartment 14 and an interconnecting passageway 16, whereby the compartment 14 holds a hair conditioner fluid 18 therein. An enlarged head 20 is provided having a chamber 22. The enlarged head 20 is integral with the handle 12, so that the chamber 22 fluidly connects to the passageway 16 in the handle 12. A plurality of bristles 24 extend upwardly from a top surface 26 of the enlarged head 20. A facility 28 is for dispensing the hair conditioner fluid 18 from the compartment 14 through the passageway 16, through the chamber 22 and into the bristles 24. The hair conditioner fluid 18 can be massaged by the bristles 24 directly into and smoothly through long hair on the head of a person to eliminate knots and tangles in the hair.

A structure 30 is for opening and closing a distal free end 32 of the handle 12, so that the hair conditioner fluid 18 can be poured through the distal free end 32 and into the chamber 22 in the handle 12 from a container 34, to refill the chamber 22 when empty. A mechanism 36 is for manually sealing and unsealing the passageway 16 in the handle 12. A person grasping the handle 12 can control the flow of the hair conditioner fluid 18 from the compartment 14 in the handle 12 to the chamber 22 in the enlarged head 20.

The dispensing facility 28 includes a finger pump 38 on the handle 12 in cooperation with the compartment 14. A one-way air entrance valve 40 on the handle extends into the compartment 14. A plurality of flexible perforated tubular members 42 are provided. Each flexible perforated tubular member 42 extends upwardly through the top surface 26 of the enlarged head 20, is fluidly connected to the chamber 22 and is interspersed among the bristles 24. When the finger pump 38 is depressed, with cooperation with the one-way air entrance valve 40, some of the hair conditioner fluid 18 in the compartment 14 will be forced through the passageway 16, through the chamber 22, up through the flexible perforated tubular members 42 and into the bristles 24. The finger pump 38 is a flexible curved plunger 44 on the handle 12 connected into the compartment 14.

The opening and closing structure 30 consists of the handle 12 being cylindrical and having external threads 46 about the distal free end 32. An end cap 48 is provided, having internal threads 50. The end cap 48 can unscrew from and screw onto the external threads 46 on the distal free end 32 of the handle 12.

The manually sealing and unsealing mechanism 36 comprises a switch assembly 52 in the passageway 16 in the handle 12. A control knob 54 on the housing 12 is connected to the switch assembly 52. When the control knob 52 is manually manipulated to an on position, the switch assembly 52 will allow the flow of the hair conditioner fluid 18 from the compartment 14 in the handle 12 to the chamber 22 in the enlarged head 20. When the control knob 52 is manually manipulated to an off position, the switch assembly 52 will restrict the flow of the hair conditioner fluid 18 from the compartment 14 in the handle 12 to the chamber 22 in the enlarged head 20.

The handle 12, the enlarged head 20 and the end cap 48 are all fabricated out of a durable strong material. The durable strong material can be plastic 56, as shown in FIGS. 3 and 4. The durable strong material can also be metal 58, as shown in FIGS. 5, 6 and 7. Each flexible perforated tubular member 42 is fabricated out of soft plastic 60, as shown in FIG. 4. The flexible curved plunger 44 is made out of rubber 62, as shown in FIG. 3. The flexible curved plunger 44 can also be made out of compressible soft plastic, not shown in the drawings.

LIST OF REFERENCE NUMBERS

10 conditioning and untangling hairbrush
12 handle of 10
14 compartment in 12
16 passageway in 12
18 hair conditioner fluid
20 enlarged head of 10
22 chamber in 20
24 bristle of 10 on 26
26 top surface of 20
28 dispensing facility of 10
30 opening and closing structure of 10
32 distal free end of 12
34 container for 18
36 manually sealing and unsealing mechanism of 18
38 finger pump of 28
40 one-way air entrance valve of 28
42 flexible perforated tubular member of 28
44 flexible curved plunger for 38
46 external threads on 32
48 end cap of 30
50 internal threads in 48
52 switch assembly of 36 in 16
54 control knob of 36
56 strong durable material (plastic) for 12, 20 and 48
58 strong durable material (metal) for 12, 20 and 48
60 soft plastic for 42
62 rubber for 44

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A conditioning and untangling hairbrush comprising:

a) a handle having a first compartment and an interconnecting passageway, whereby said first compartment holds a hair conditioner fluid therein;

b) an enlarged head having a chamber, said enlarged head being integral with said handle, so that said chamber fluidly connects to said passageway in said handle;

c) a plurality of bristles and perforated, flexible tubular members extending upwardly from a top surface of said enlarged head;

d) means for dispensing the hair conditioner fluid from said first compartment through said passageway, through said chamber and into said tubular members for discharging the fluid into the hair, so that the hair conditioner fluid can be massaged by said bristles directly into and smoothly through long hair on the head of a person to eliminate knots and tangles in the hair;

e) a second compartment formed in said passageway having openings at opposite ends communicating with said first compartment and said chamber, respectively;

f) said handle being substantially cylindrical in shape with the distal end having an externally threaded mouth and an internally threaded cap for being removed to permit said hair conditioner fluid to be decanted into said first compartment;

g) switch means mounted on the outside of said passageway and extending into said second compartment for controlling flow of said fluid from said first compartment through said second compartment into said chamber, said switch means being manipulated between a first position permitting flow through said passageway and a second position blocking flow through said passageway;

h) said dispensing means comprising finger pump means having a flexible curved plunger mounted on said handle communicating with said first compartment for pumping fluid from said first compartment through said passageway to said chamber and out through said tubular members when said switch means is in the open position; and i) vent means in said handle between said finger pump means and said distal end comprising a one way valve for permitting air to replace fluid being pumped out of said first compartment.

* * * * *